United States Patent [19]

Bloomquist et al.

[11] 4,173,976

[45] Nov. 13, 1979

[54] POUCH DESIGN BRIEF

[75] Inventors: Lynn M. H. Bloomquist, Minnetonka; Robert J. Brazil, Bloomington, both of Minn.

[73] Assignee: Munsingwear, Inc., Minneapolis, Minn.

[21] Appl. No.: 843,590

[22] Filed: Oct. 19, 1977

[51] Int. Cl.[2] ..... A41B 9/02; A61F 5/40

[52] U.S. Cl. ..... 128/159; 2/403

[58] Field of Search ..... 2/403, 404, 405, 409; 128/159, 158

[56] References Cited

U.S. PATENT DOCUMENTS

| | | | |
|---|---|---|---|
| 2,310,839 | 2/1943 | Chatfield et al. | 128/159 |
| 2,328,953 | 9/1943 | Chatfield et al. | 128/159 |
| 3,599,241 | 8/1971 | Rossler | 2/409 |
| 3,768,471 | 10/1973 | Belpaume | 2/403 X |

FOREIGN PATENT DOCUMENTS

| | | | |
|---|---|---|---|
| 520920 | 1/1956 | Canada | 128/159 |
| 462426 | 5/1937 | United Kingdom | 128/159 |

*Primary Examiner*—H. Hampton Hunter

*Attorney, Agent, or Firm*—Merchant, Gould, Smith, Edell, Welter & Schmidt

[57] ABSTRACT

An improved men's undergarment having a no-fly construction and including a suspensory pouch sized to conform to the body contours of the wearer. The undergarment includes front and rear panels sewn together to encircle the body and a crotch panel sewn to the front and rear panels. The crotch panel is formed of a material having a stretch bias oriented to provide a comfortable fit and support regardless of body movement.

4 Claims, 4 Drawing Figures

POUCH DESIGN BRIEF

BACKGROUND OF THE INVENTION

The present invention relates broadly to men's undergarments, and in particular to men's undergarments generally referred to as men's briefs or men's shorts. Specifically, the present invention relates to men's briefs having a no-fly construction that includes a suspensory pouch adapted to conform to the body contours of the wearer.

Men's undergarments that are referred to as briefs are generally constructed to conform snugly to body contours. Typically, the conventional prior art men's briefs are provided with a fly construction. Additionally, it is known in the prior art to provide a suspensory pouch in the undergarment for support of the male genitalia. Recently, it has become apparent in the undergarment industry that a fly construction does not provide a fashionable undergarment. Additionally, the fly may not be used in its intended manner in many instances by the wearer. Therefore, the provision of a fly construction in men's briefs is perhaps unnecessary and merely adds to the manufacturing costs.

Additionally, the prior art pouch structures, while providing adequate support, are not cut to provide comfortable fit and to allow for body movement. The wearer may thus experience some discomfort by assuming a position in which the undergarment has a tendency to pinch the body or apply pressure to the body.

The present invention eliminates the disadvantages of the prior art men's undergarments in that it is an improved men's brief with a no-fly construction and which is provided with a suspensory pouch constructed for comfortable fit and support. By eliminating the fly structure, the manufacturing cost of the men's briefs of the present invention is substantially reduced. The present invention also includes a suspensory pouch constructed to provide adequate room for comfort in addition to support. The pouch construction accommodates body movements to achieve a comfortable supporting fit in a fashionably masculine undergarment.

SUMMARY OF THE INVENTION

The present invention is a men's undergarment having a body member sized to encircle the body. The body member has a front portion, a rear portion and top and bottom edges. The bottom edge of the front portion includes a concave arcuate portion. The undergarment further has a crotch member with a bottom or seat portion and a pair of symmetrical wing members. Each wing member has a lateral edge and a convex arcuate end edge. The wing members are joined to each other along the lateral edge to form a vertical seam and also joined along the convex arcuate edge to the concave arcuate portion of the bottom edge of the front panel. The bottom portion of the crotch panel is also joined to the bottom edge of the rear panel. The crotch panel thereby forms a support pouch and is made of material having a stretch bias oriented so that the support pouch will stretch in a direction generally from the arcuate front seam toward the vertical seam. The wing members are sized larger proximate the convex arcuate end edges than proximate the bottom portion of the crotch member to provide adequate room for a comfortable fit.

In the preferred embodiment, the men's undergarment of the present invention includes a front panel and a rear panel with side edges that are joined to form side seams. The rear panel is cut so that side edges converge at a small angle toward the midline of the rear panel from the bottom edge of the rear panel to the top edge of the rear panel. The side seam therefore is oriented at a slight angle with respect to the vertical in a direction toward the front of the undergarment so that the undergarment rides higher on the body in the back than in the front. The undergarment will remain in place as the wearer bends or sits. The rear panel is additionally cut larger than the front panel to provide ample room for a comfortable contour fit of the undergarment about the buttocks of the wearer.

The present invention is, therefore, an improved men's undergarment which by the simplicity of its construction substantially reduces manufacturing cost. The men's undergarment has a suspensory pouch constructed to provide adequate room and is of a material having stretch bias orientation that provides support and accommodates body movements. The undergarment is a fashionable men's brief construction which conforms to the body contours. These and other advantages of our invention will become apparent with reference to the accompanying drawings, detailed description of the preferred embodiment, and the claims.

DETAILED DESCRIPTION OF THE PREFERRED EMBODIMENT

Figure 1:
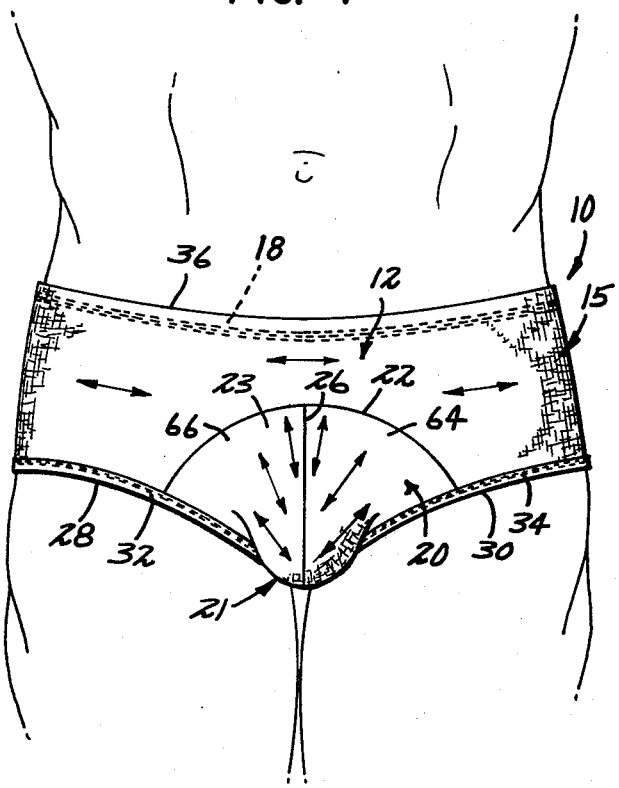
FIG. 1 is a front elevational view showing the men's undergarment of the present invention as it is worn.

Referring to the drawings, wherein like numerals represent like parts throughout the several views, a men's undergarment of the present invention is designated generally as 10. Undergarment 10 includes a front panel 12 and a rear panel 14 which are sewn together to form a body member 15 which encircles the body. It is contemplated that body member 15 could also be made of a single blank of material as opposed to two joined panels. Front panel 12 and rear panel 14 are joined by a pair of side seams, one of which is shown at 16. Sewn within body member 15 along the top edge thereof is a waistband 18 of elastic material serving to secure undergarment 10 about the waist. Undergarment 10 also has a crotch panel 20 sewn to front panel 12 along an arcuate seam 22 and sewn to rear panel 14 along an arcuate seam 24. Crotch panel 20 also has a substantially vertical seam 26 that will be described in more detail hereafter. Leg openings 28 and 30 are defined about the bottom edge of undergarment 10. A pair of suitable reinforcing bands 32 and 34 are provided about leg apertures 28 and 30, respectively. Bands 32 and 34 may be made of a suitable elastic material.

Figure 4:
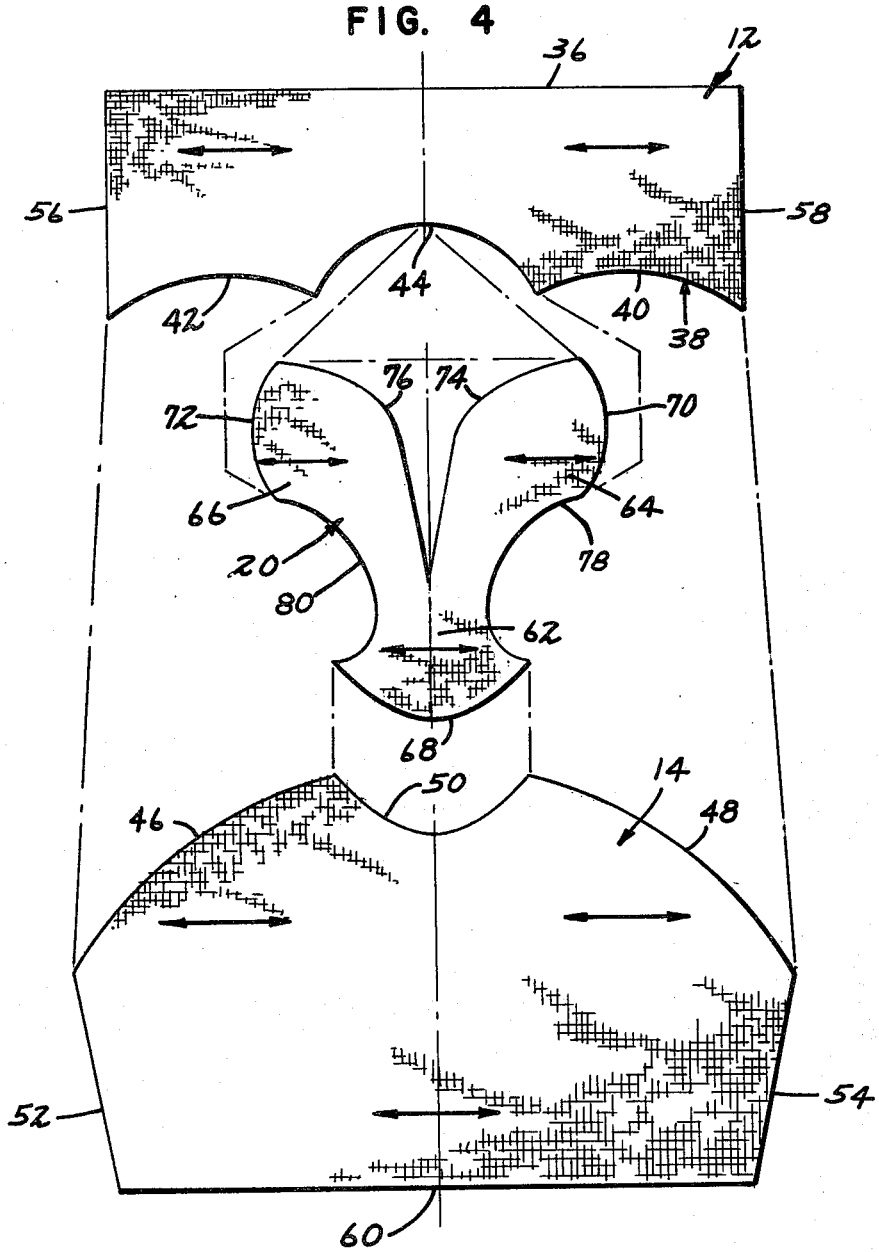
FIG. 4 is a plan view to the panels of material before the panels are sewn together to form the men's undergarment of the present invention.

FIG. 4 illustrates front panel 12, rear panel 14 and crotch panel 20 as appropriately cut blanks of material before they are sewn together to form men's undergarment 10. Front panel 12 has a top edge 36 and a bottom edge 38. Bottom edge 38 has a pair of arcuate concave segments 40 and 42 each having a first radius of curvature and disposed symmetrically with respect to a midline of front panel 12. Centered on the midline of front panel 12 is an arcuate concave segment 44 of edge 38 having a second radius of curvature smaller than the radius of curvature of arcuate segments 40 and 42.

Figure 2:
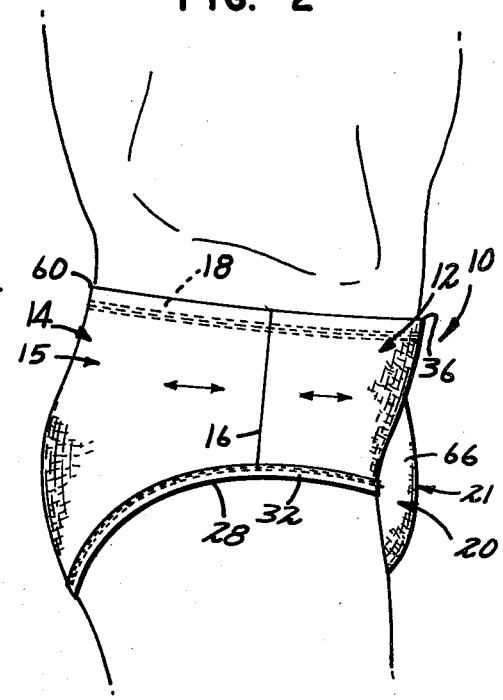
FIG. 2 is a side elevational view showing the men's undergarment of the present invention as it is worn.
Figure 3:
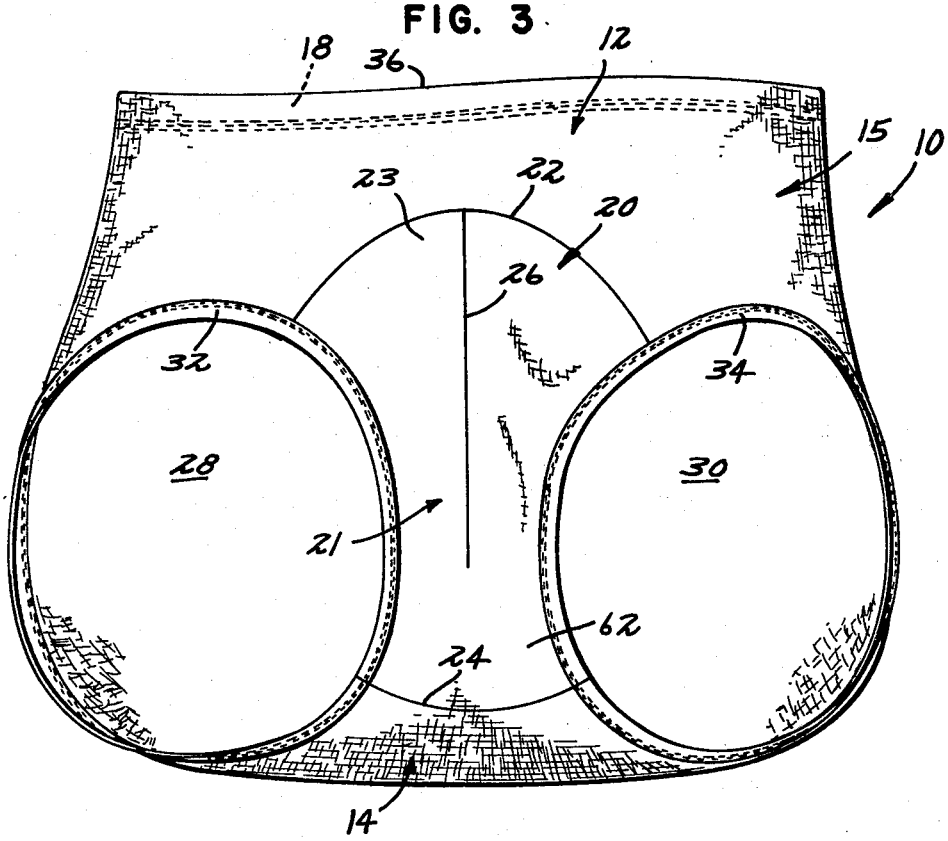
FIG. 3 is a view in elevation of the men's undergarment of the present invention lying flat with the bottom or seat portion folded toward the front panel to illustrate the bottom seam and leg apertures.

Rear panel 14 has convex arcuate edges 46 and 48 which are disposed symmetrically with respect to a midline of rear panel 14. Centered about the midline of rear panel 14 is a concave arcuate edge 50. Rear panel 14 also has a pair of side edges 52 and 54 cut at a relatively small angle with respect to the midline of rear panel 14. Side edges 52 and 54 converge gradually from convex arcuate edges 46 and 48, respectively, toward the midline of rear panel 14. Front panel 12 has a pair of side edges 56 and 58 to which side edges 52 and 54 of rear panel 14 are joined along seams 16. As shown in FIG. 2, when undergarment 10 is worn, seams 16 lie along a line at a small acute angle with respect to the vertical such that a top edge 60 of rear panel 14 will ride slightly higher on the body than the top edge 36 of front panel 12. Rear panel 14 is cut substantially larger or fuller than front panel 12 to provide adequate room for comfortable fit of undergarment 10 about the buttocks.

Crotch panel 20 has a bottom portion 62 and a pair of symmetrical wing members 64 and 66 which extend outwardly in opposite directions from a midline of crotch panel 20. Bottom portion 62 has a convex arcuate edge 68 which is joined to edge 50 of rear panel 14 along seam 24. Wing members 64 and 66 have upper concave arcuate edges 70 and 72 that are joined along arcuate segment 44 forming front seam 22. Wing members 64 and 66 also have arcuate lateral edges 74 and 76 that curve generally upward from bottom portion 62 and outward in opposite directions from the midline of panel 20 and which are joined to each other along the midline to form vertical seam 26. Crotch panel 20 also has concave lateral edges 78 and 80 which along with edges 38 and 42 of front panel 12 and edges 46 and 48 of rear panel 14 define leg apertures 28 and 30.

When sewn to front panel 12 and rear panel 14, crotch panel 20 forms a suspensory pouch 21 for support of the male genitalia. Panel 20 is cut with wing members 64 and 66 increasing in size from bottom portion 62 to arcuate edges 70 and 72 providing a top portion 23 with adequate fullness and room for a comfortable fit of pouch 21.

As illustrated in FIG. 4, the material of which undergarment 10 is made is selected to have a stretch bias direction transverse to the midline as shown by the double-headed arrows. In the preferred embodiment undergarment 10 and crotch panel 20 in particular are made of a knit fabric. As is known in the industry, knit fabrics have a preferred stretch bias orientation. When front panel 12, rear panel 14 and crotch panel 20 are sewn together, the stretch bias of the material will be as shown in particular in FIG. 1. The stretch bias of front panel 12 and rear panel 14 is generally transverse to the midline of the undergarment while the stretch bias of crotch panel 20 is generally from arcuate front seam 22 toward vertical seam 26. The direction of the stretch bias of crotch panel 20 allows the suspensory pouch to conform to the body contours of the wearer and provide adequate support as the wearer moves or changes position. The pouch is thus designed both for support and comfort while accommodating body maneuverability.

As previously mentioned, when undergarment 10 is worn, top edge 60 of rear panel 14 rides higher on the back than top edge 36 of front panel 12 on the front. This structure facilitates in maintaining undergarment 10 in position while the wearer bends or sits.

From the above description, it will be understood that the present invention provides an improved men's undergarment incorporating a suspensory pouch that has a stretch bias to conform to the body contours of the wearer providing both comfort and support. In addition, undergarment 10 is of a relatively simple construction in that it eliminates the conventional fly of the prior art men's briefs. Rear panel 14 is cut to increase seat room and length and joined to front panel 12 such that briefs 10 ride higher on the body in the back than in the front thereby maintaining briefs 10 in place while the wearer sits or bends. The present invention is a fashionably masculine men's undergarment characterized by simplicity of construction.

We claim:

1. A men's undergarment, comprising:

(a) a body member sized to encircle the body and further comprising:

(i) a front panel having top, bottom, and side edges, said bottom edge having a concave arcuate portion;

(ii) a rear panel having top, bottom, and side edges, said edges converging from said bottom to said top edge of said rear panel in a direction generally toward the midline of said rear panel and at an acute angle with respect to said midline, said rear panel joined to said front panel along said side edges of said front and rear panels forming side seams oriented at a slight angle with respect to the vertical so that said body member rides higher on the back than on the front of the body;

(b) a crotch member having a bottom portion and a pair of symmetrical wing members, each wing member having a lateral edge and a convex arcuate end edge, said wing members joined to each other along said lateral edge to form a vertical seam and joined along said convex arcuate edges to said concave arcuate portion of said bottom edge of said front panel to form an arcuate front seam, said bottom portion joined to said bottom edge of said rear panel forming a suspensory pouch, said crotch member formed of material having a stretch bias oriented so that said suspensory pouch will stretch in a direction generally from said arcuate front seam toward said vertical seam.

2. A men's undergarment in accordance with claim 1 wherein said wing members are sized larger proximate said convex arcuate end edges than proximate said bottom portion.

3. A men's undergarment in accordance with claim 1 wherein said bottom portion of said crotch member has a convex arcuate edge and wherein said bottom edge of said rear panel has a concave portion, said convex arcuate edge of said bottom portion joined to said convex arcuate edge portion to form an arcuate bottom seam.

4. A men's undergarment in accordance with claim 3 wherein said rear panel is cut substantially larger than said front panel to provide adequate room to conform to the buttocks of the wearer.

* * * * *